United States Patent [19]

Vickery

[11] 4,241,719

[45] Dec. 30, 1980

[54] HEATER STOVE APPARATUS

[76] Inventor: Joseph K. Vickery, Rte. 2, Liberty, S.C. 29657

[21] Appl. No.: 887,500

[22] Filed: Mar. 17, 1978

[51] Int. Cl.[3] ..... F24B 3/00

[52] U.S. Cl. ..... 126/66; 126/113; 126/290; 126/134

[58] Field of Search ..... 126/60, 66, 61, 63, 126/72, 109, 110 R, 101, 197, 290, 113, 134, 285 A, 67, 58, 121, 120

[56] References Cited

U.S. PATENT DOCUMENTS

| | | | |
|---|---|---|---|
| 9,444 | 12/1852 | Gates | 126/109 |
| 546,026 | 9/1895 | Nutz | 126/290 |
| 882,212 | 3/1900 | Scott | 126/58 |
| 1,175,666 | 3/1916 | Taylor | 126/58 |
| 1,434,083 | 10/1922 | Brander | 126/121 |
| 1,607,309 | 11/1926 | Romig | 110/189 X |
| 3,667,451 | 6/1972 | Boucher | 126/110 R |
| 4,092,976 | 6/1978 | Buckner | 126/63 |
| 4,106,474 | 8/1978 | Hunter et al. | 126/110 R |

FOREIGN PATENT DOCUMENTS

| | | | |
|---|---|---|---|
| 521709 | 7/1921 | France | 126/120 |
| 3612 | of 1868 | United Kingdom | 126/67 |
| 4565 | of 1886 | United Kingdom | 126/285 A |

*Primary Examiner*—Samuel Scott
*Assistant Examiner*—Lee E. Barrett
*Attorney, Agent, or Firm*—Bailey, Dority & Flint

[57] ABSTRACT

A heater stove apparatus is disclosed as including an enclosed stove housing having a fire chamber in which a suitable fuel is burned for heating. A heat collector manifold is provided for receiving the combustion products from the fire chamber and a plurality of heat pipes extend between the fire chamber and the heat manifold for delivery of heat and combustion products to the heat collection manifold. An air flow path extends generally vertically the height of the heat pipes and horizontally along one of the dimensions of the stove housing with the path being defined in part by the bottom surface of the heat manifold in an upper surface of the fire chamber. A means is provided for circulating air generally through the stove housing along the air flow path. A unique draft door arrangement is provided which rids the fire chamber of smoke prior to the door being opened for access to the interior of the fire chamber.

13 Claims, 7 Drawing Figures

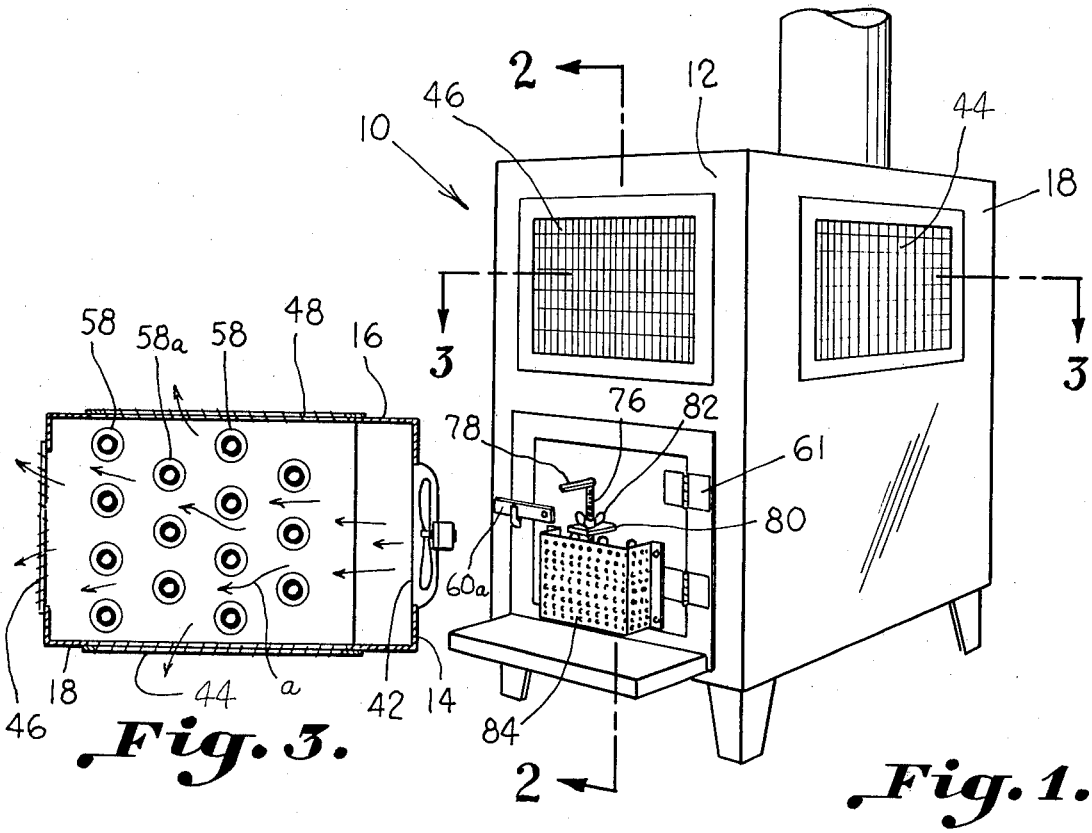
Fig. 3.
Fig. 1.
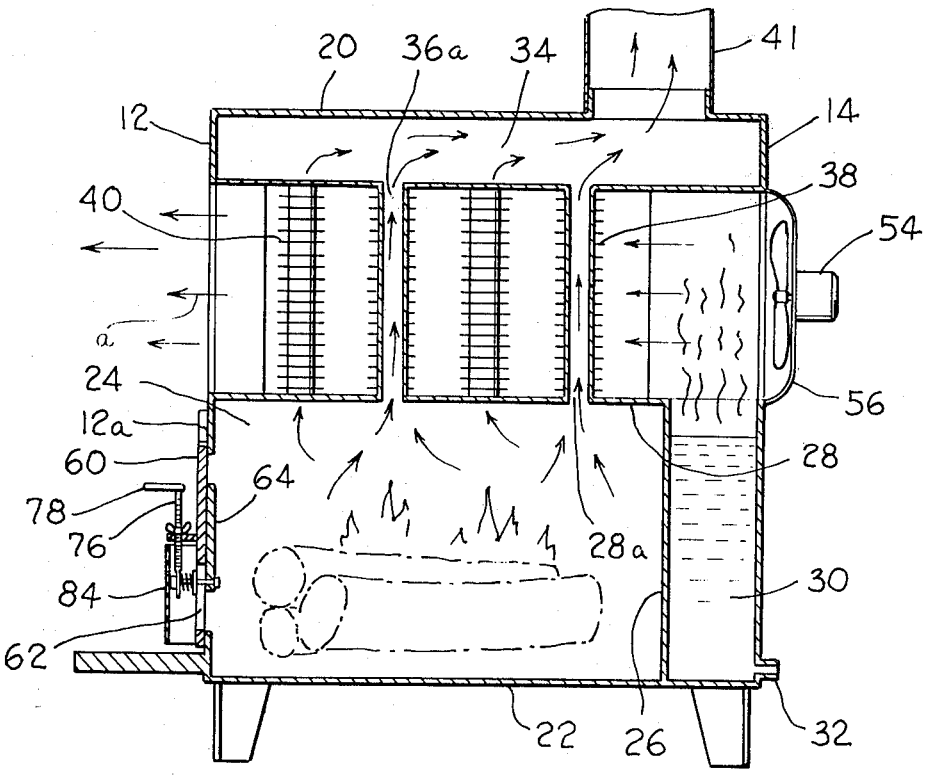
Fig. 2.

HEATER STOVE APPARATUS

BACKGROUND OF THE INVENTION

The present invention is directed to a wood or coal burning heater stove apparatus. While wood burning heater stoves and fireplaces have long been utilized for heating purposes, the recent shortages of conventional and perhaps more convenient sources of energy have brought about a renewed interest in wood and coil burning stoves and in improving the effectiveness and operation thereof.

Generally, there are two types of wood or coal burning stoves. In the radiating type, the heat of combustion is radiated outwardly from the walls of the stove into the room. Secondly, is the type in which air is used to transfer the heat of combustion into the room. This type normally involves passing air along passages and surfaces of the stove to conduct the heat away and distribute the heat into the room. This type normally produces a stove whose outer wall surfaces are cooler than the radiating type and is generally safer for home use.

U.S. Pat. Nos. 499,892 and 2,789,544 disclose prior heater stoves which circulate air through and about various heated surfaces and compartments of the stove to transfer the heat therefrom.

U.S. Pat. No. 1,681,995 discloses a similar concept applied to a fireplace structure in which air is circulated in and around various heated surfaces of the heater and then distributed to the room.

These devices require a rather elaborate construction since the air is circulated generally from the bottom to a top portion and outwardly therefrom along a series and tortuous path requiring the construction of paneled passageways and other structure to define an air flow path through the heater. The prior structures do not lend themselves readily to the adaptation of present day heating systems which utilize a central distribution of heated air by means of a blower and central duct system.

Accordingly, an important object of the present invention is to provide a heater stove apparatus having an improved heat exchange and air flow path arrangement for increased heat exchange and efficiency.

Another important object of the present invention is to provide a heater stove apparatus having efficient heat exchange and air circulation characteristics which may be adapted either for the general circulation of air or for use in a conventional central heating system.

Another important object of the present invention is to provide a heating stove apparatus having a unique draft door arrangement for adjusting the air draft in the fire chamber and for ridding the chamber of smoke as the draft door is opened for access to the chamber.

Still another important object of the present invention is the provision of a heater stove apparatus having a plurality of heat delivery pipes arranged in staggered rows in the air circulation paths for delivery of heat to a heat collection manifold resulting in a highly effective heat exchange characteristic.

SUMMARY OF THE INVENTION

It has been found that a heating stove apparatus can be provided having increased heat exchange capabilities and may be used either as a room stove or a stove in combination with an existing central heating system. The heating stove apparatus comprises an enclosed stove housing having a fire chamber in which a suitable fuel is burned for heating. A heat collector manifold is provided for receiving the heat and combustion products from the fire chamber and a plurality of heat delivery pipes extend between the fire chamber and the heat manifold for delivery of heat and combustion products. An air flow path extends generally vertically the height of the heat pipes and extends generally horizontally along one of the dimensions of the stove housing. The air path is defined in part by a bottom surface of the heat manifold and an upper surface of the fire chamber. Means is provided for circulating air generally through the stove housing and along the air flow path.

A draft door carried by the stove housing provides access to the interior of the fire chamber and has at least one draft opening providing entrance of air into the chamber. A slide plate carried by the draft door provides a desired coverage of the draft opening. An adjustable means is provided for adjustably setting the desired coverage position of the slide plate over the draft opening including a handle operatively connected to the slide plate for simultaneously opening the draft door and uncovering the draft opening when grasped manually to increase the draft in the fire chamber and rid the chamber of smoke immediately prior to opening the door.

BRIEF DESCRIPTION OF THE DRAWINGS

The construction designed to carry out the invention will be hereinafter described, together with other features thereof.

The invention will be more readily understood from a reading of the following specification and by reference to the accompanying drawing forming a part thereof, wherein an example of the invention is shown and wherein:

FIG. 1 is a perspective view illustrating the stove apparatus constructed in accordance with the present invention;

FIG. 2 is a sectional view taken along the line 2—2 of FIG. 1;

FIG. 3 is a sectional top plan view taken along 3—3 of FIG. 1;

DESCRIPTION OF A PREFERRED EMBODIMENT

Figure 7:
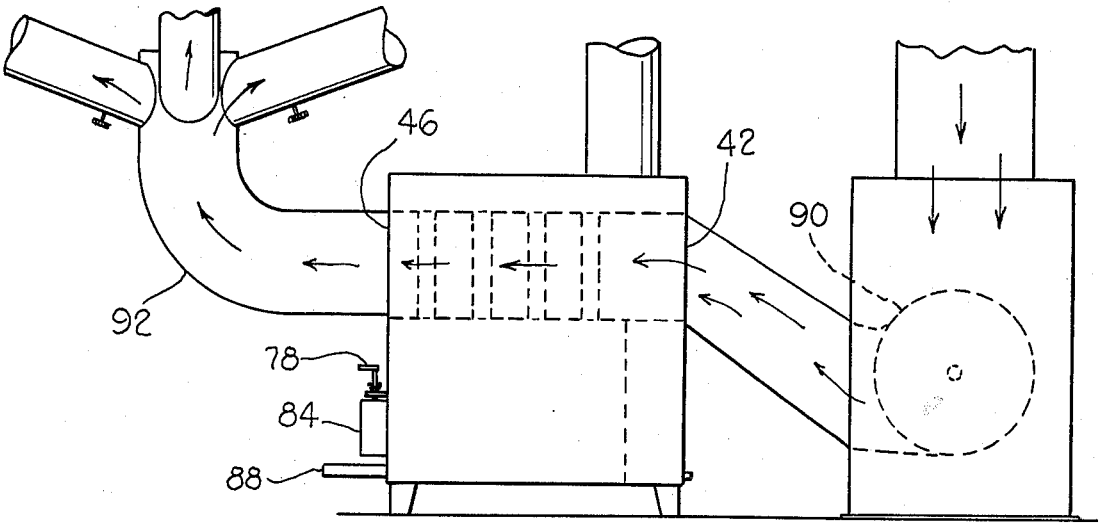
FIG. 7 is a schematic view illustrating a heating stove apparatus constructed in accordance with the present invention that is adapted for use in an existing central heating system.
Figure 6:
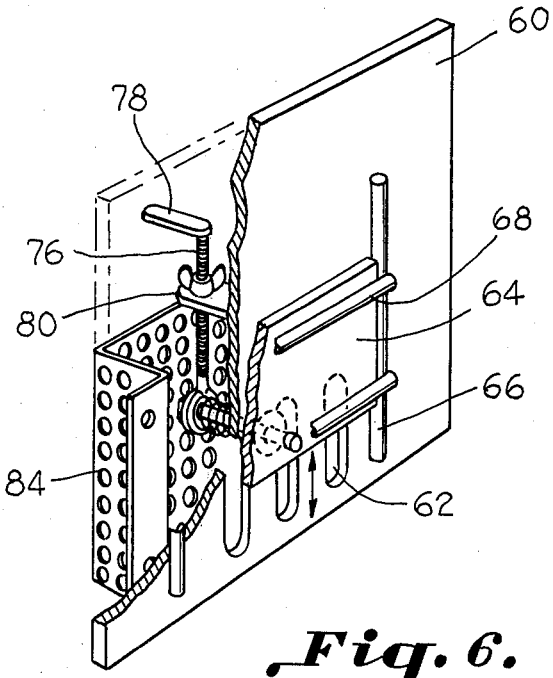
FIG. 6 is a perspective partially cut-away view illustrating a draft door constructed in accordance with the present invention.
Figure 4:
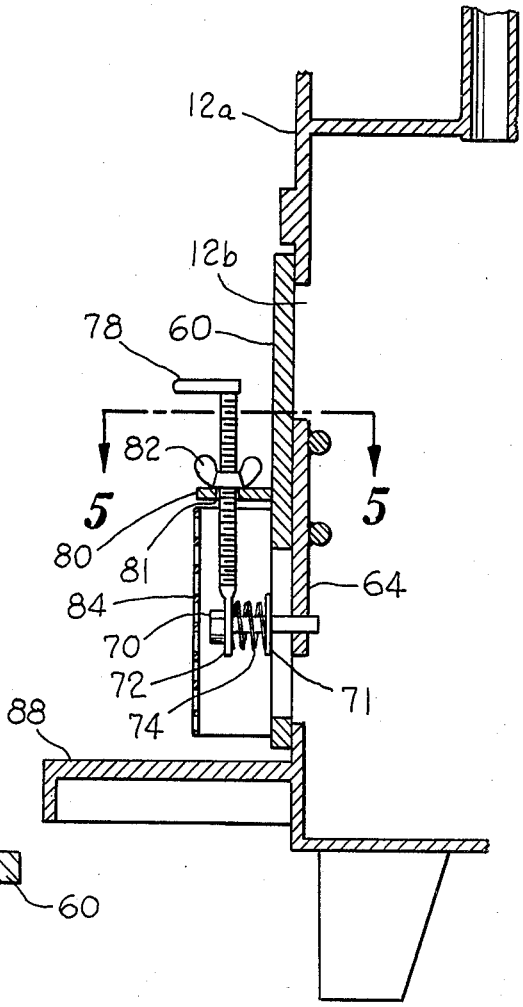
FIG. 4 is a partial cut-away view of the front end of the stove and fire chamber portion illustrating the details of the draft door and stove constructed in accordance with the present invention.
Figure 5:
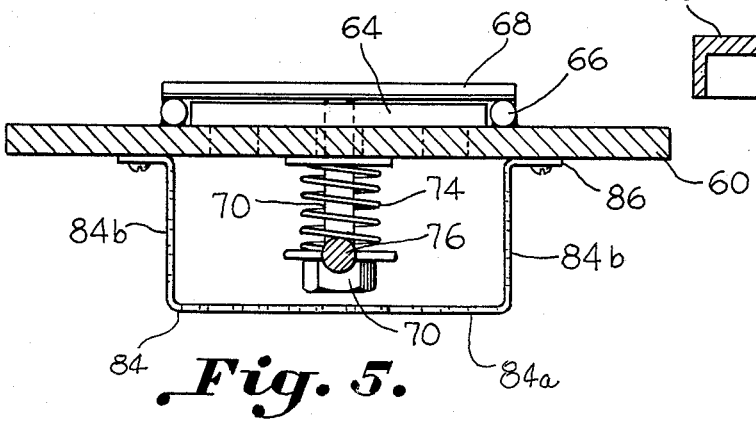
FIG. 5 is a sectional view taken along the line 5—5 of FIG. 4.

The drawings illustrate a heater stove apparatus designated generally at 10 being of generally rectangular construction having opposed spaced end walls 12 and 14 integral with spaced opposed side walls 16 and 18. A top plate 20 and bottom plate 22 integral with the end and side walls complete the stove housing. Legs 23 support the stove above the floor.

A fire chamber 24 is provided wherein a suitable fuel such as wood or coal is burned for heating. The side wall 12 of the stove provides a front wall 12*a* of the fire chamber and includes a door opening 12*b* providing access to the interior of the chamber. The fire chamber is further defined by the bottom plate 22 and the side walls 16 and 18 of the stove housing and the enclosure is completed by a rear wall 26 and a top plate 28.

A water reservoir 30 is defined by the rear wall 26 of the fire chamber and the end wall 14 of the stove housing. A port 32 may be provided for filling and draining the reservoir 30 with water. The water reservoir is open at the top and when heated will release vapors into the path of the air being heated.

A heat collection manifold 34 is provided for receiving the heat and combustion products from the fire chamber 24. The side walls and end walls of the heat manifold are provided by the side walls 16 and 18 and end walls 12 and 14 of the stove housing. Integral with the side walls and end walls are the top plate 20 of the stove housing and a bottom plate 36 which completes the enclosure of the heat manifold.

It will be noted that the top plate 28 of the fire chamber and the bottom plate 36 of the heat collection manifold are provided with circular perforations such as 28*a* and 36*a*. Between the aligned perforations of each plate, an open-ended heat delivery pipe 38 extends for delivering the heat and combustion products from the chamber 24 to the manifold 34. The heat pipes are provided with heat transfer fins 40 to efficiently transfer the heat from the heated tubes to the air passing thereover. The products of combustion are drawn through a flue 41 to the outside.

Means are provided for establishing an air flow path, indicated by arrows "a," through the stove housing for efficiently transferring the heat of combustion to the air passing therethrough. The air flow path extends generally in a vertical direction the height of the heat pipes 38 and extends generally horizontally along the length dimension of the side walls of the stove housing 10. The air path means is defined in part by the surface of the bottom plate 36 of the heat manifold and the surface of top plate 28 of the fire chamber. Means for circulating the air generally through the stove housing along the air flow path is provided by air inlet and outlet openings 42, 44, 46 and 48 formed in opposed spaced walls of the stove housing. As illustrated, the openings are rectangular in shape and are provided with grill-type covers which may be of the louvered type for directing the air as desired. The circulation means may include a blower provided by an electric fan 54 having a protective grill 56 securing the fan to the stove housing adjacent the opening 42 which then serves as the air inlet opening. The blower delivers the air from the inlet along the air path and outwardly through the outlet openings 44, 46 and 48. In applications with the fan omitted, the air circulates along the air path means in and out of the openings 42, 44, 46, and 48 in a random pattern.

As illustrated in FIG. 3, it can be seen that the heat pipes 38 are arranged in rows 58 across the air flow path and that the heat pipes of next adjacent rows are offset in their relative lateral positioning providing increased heat transfer surface area exposed to the oncoming air. In the illustrated embodiment, it can be seen that the alternate rows 58*a* next adjacent the rows 58 have heat pipes which are located approximately at the middle of the lateral spacing between the heat pipes in row 58.

A draft door 60 is carried by the stove housing by any suitable means such as hinges 61 for covering the access opening 12*b* of the fire chamber 24. A pivotal latch 60*a* is carried on door 60 for latching the door in a closed position. A draft opening in the form of at least one vertical slot 62 is provided in the draft door for allowing air to enter the fire chamber. In the preferred embodiment, a plurality of the slots 62 are utilized. A slide plate 64 is carried by the draft door for selectively covering a desired portion of the slots 62 so as to control the amount of air entering the fire chamber. The slide plate 64 slides vertically within a guide frame composed of vertical bars 66 and horizontal cross bars 68 which may be fastened such as by welding to the draft door. As illustrated, the slide plate is carried on the back portion of the draft door.

A horizontal bolt member 70 extends through one of the vertical slots 62 and is secured to the slide plate 24 by any suitable means such as threading an opening in the slide plate 24 and inserting a threaded end of the bolt 70 therein. A pair of flat washers 71 and 72 are carried by the bolt 70 on the front side of the draft door and a biasing spring 74 is carried between the flat washers for biasing the slide plate 64 snug against the back of the draft door.

Means are provided for adjustably positioning the slide plate 64 over the draft opening 62 in the form of a threaded rod 76 having one end welded to the flat washer 72 and an integral handle portion 78 carried on the opposing end. The threaded rod 76 is carried by a guide flange 80 which may be welded to the draft door 60. The rod is received in an opening 81 formed in the guide flange 80 for free movement relative to the guide flange. A wingnut 82 is threadably carried on the rod 76 above the guide flange for adjusting the vertical position thereof relative to the guide flange 80. It will be noted that the wingnut 82 will limit the downward movement of the threaded rod 76 and hence the slide plate 64. This provides a means for locking the slide plate 64 in a desired vertical position over the draft openings 62.

In opening the draft door 60 by manually grasping the handle 78, it will be noted that the rod 76 will be pulled upwardly in free movement relative to the guide flange 80 causing the draft openings 62 to be uncovered and opened to their fullest extent. This simultaneous opening of the draft openings 62 when opening the draft door 60 will rid the fire chamber 24 of smoke by increasing the draft immediately prior to opening the door. Thus the problem of the draw of the smoke reversed into the room upon opening the draft door is virtually eliminated according to this unique draft door arrangement.

In one form of the invention, draft openings 62 were constructed to be approximately $3\frac{1}{2}$ inches in vertical height and $\frac{5}{8}$ of an inch in width. Although the size of the draft openings is larger than is typically the case, the increased draft provided thereby increases the range of wide-open operation of the stove and the heating capacity thereof. A spark arrestor plate 84 is carried on the outside of the draft door covering the draft openings to prevent the flight of sparks outwardly from the draft openings, particularly during wide-open operation. In the preferred form, the spark arrestor plate includes a generally U-shaped housing having an open top and bottom with perforated front and side portions 84*a* and 84*b*. Integral with side portions 84*b* are turned out flange portions 86 which may be utilized to secure the spark arrestor plate to the draft door 60. An apron 88 is carried by the stove housing below the draft door 60 to prevent ashes from falling directly onto the floor.

As illustrated in FIG. 7, the heater stove may be advantageously utilized with an existing central heating system of a building or dwelling. Such a system typically includes a blower 90 for delivering air throughout a duct system 92 which distributes the air centrally throughout the building or dwelling. The heater stove according to the invention may be inserted into the duct distribution system as illustrated with the inlet of the stove 42 connected to the pressure side of the blower 90 and the outlet 46 of the stove connected in the trunk of the duct system 92. It may be desired to omit the side air openings 44 and 48 in this application. The stove may be in series with the flow of air from the conventional burner of the heating system and suitable controls may be provided where the wood burning stove 10 and a conventional burner of a heating system are used either alone or in combination.

In this application, the air flow path means "a" as defined above with the heat pipes 58 staggered thereacross presents a highly effective transfer of heat from the wood burning fire chamber to the air passing through the air flow path. In central heating systems, the air is normally circulated at a fast flow rate and the increased contact provided by the finned heat pipes 38 with the air flowing therethrough certainly enhances the efficiency and effectiveness of the heater stove. The generally linear flow path of the air through the stove is particularly advantageous for use with existing central type heating systems. It may be desirable in this application to place the draft door 60 on a side of the stove rather than at the front.

It can be readily appreciated that by utilizing the principles of the present invention an improved wood burning heating stove having very high efficiency and heat exchange capacity is provided.

While a preferred embodiment of the invention has been described using specific terms, such description is for illustrative purposes only, and it is to be understood that changes and variations may be made without departing from the spirit or scope of the following claims.

What is claimed is:

1. Heating stove apparatus comprising:

an enclosed stove housing;

a fire chamber within said housing in which a suitable fuel is burned for heating;

a draft door carried by said housing providing access to the interior of said fire chamber;

a heat collector manifold receiving the heat and combustion products from said fire chamber;

a plurality of elongated heat delivery pipes extending between said fire chamber and said heat manifold for delivery of heat and combustion products thereto, said heat pipes having open opposing ends communicating with the respective interiors of said fire chamber and heat manifold;

horizontal air flow path means extending generally vertically the height of said elongated heat pipes and extending generally horizontally along one of the dimensions of said stove housing, said air path means being defined in part by a bottom surface of said heat manifold and an upper surface of said fire chamber;

said heat pipes being arranged and aligned linearly in rows across said air path means with the heat pipes of next adjacent rows being offset in their relative lateral spacing; said heat pipes of next adjacent rows being spaced approximately mid-ways between the lateral spacing of heat pipes in said next adjacent row whereby said heat pipes contact said air flow head on and present an enlarged heat transfer surface transverse to the flow of horizontal air while affording sufficient space between said pipes to facilitate said air flow;

circulation means providing circulation of air generally horizontally through said stove housing along said air flow path means; and a water reservoir adjacent said fire chamber carried within said stove housing being open at the top for release of water vapor into said air path means.

2. The apparatus of claim 1 wherein said circulation means includes air inlet and air outlet openings provided in opposed spaced walls of said stove housing.

3. The apparatus of claim 2 wherein said circulation means includes a blower means carried adjacent in air inlet opening for delivering air through said stove housing along said air path means.

4. The apparatus of claim 2 including duct means for distributing heated air throughout an interior space from a central location and blower means for delivering said air through said duct means wherein said air inlet opening is connected to the pressure side of said blower means and said air outlet opening is connected to said duct means.

5. The apparatus of claim 1 wherein said draft door comprises:

a front hinged plate having at least one draft opening formed therein;

a vertically movable slide plate carried by said door for selectively covering a desired portion of said draft opening; and adjustable means for setting the position of said slide plate and hence the covering of said opening including handle means operatively connected to said slide plate for simultaneously opening said draft door and uncovering said draft opening when grasped manually and utilized for opening said draft;

whereby smoke is relieved in said fire chamber by increased draft prior to opening said draft door avoiding entry of same into the room.

6. The apparatus of claim 5 including a perforated spark arrestor plate carried by said door plate for arresting the flight of sparks through said draft opening affording increased draft such as may accompany opening of said draft door by said adjustable means without the attendant risk of spark emission.

7. The apparatus of claim 1 wherein said heat collector manifold is defined by spaced vertical sides integral with a top wall of said stove housing, spaced vertical ends integral with said top wall extending between said sides, and a bottom wall spaced from said top wall extending between said sides and ends, said bottom wall including openings for mating with said heat delivery pipes.

8. The apparatus of claim 1 including vertically spaced heat transfer fins carried on each said heat delivery pipes.

9. The apparatus of claim 1 wherein said water reservoir is located intermediate said fire chamber and said air inlet in said air flow path means.

10. Heating stove apparatus comprising:

an enclosed stove housing;

a fire chamber within said housing in which a suitable fuel is burned for heating;

a heat collector manifold receiving the heat and combustion products from said fire chamber;

a plurality of elongated heat delivery pipes extending between said fire chamber and said heat manifold for delivery of heat and combusion products thereto, said heat pipes having open opposing ends communicating with the respective interiors of said fire chamber and heat manifold;

air flow path means extending generally vertically the height of said elongated heat pipes and extending generally horizontally along one of the dimensions of said stove housing, said air path means being defined in part by a bottom surface of said heat manifold and an upper surface of said fire chamber;

circulation means providing circulation of air generally through said stove housing along said air flow path means;

a draft door carried by said stove housing providing access to the interior of said fire chamber having at least one draft opening providing entrance of air into said chamber;

a slide plate carried by said draft door for selectively covering said draft opening a desired amount; and adjustable means operatively connected to said slide plate for setting the desired coverage position of said slide plate over said draft opening; and said adjustable means including handle means by which said slide plate is movable freely to simultaneously uncover said draft opening when said handle means is grasped manually and utilized to open said draft door to rid the fire chamber of smoke generally simultaneously with opening said door whereby entry of smoke into the room is avoided.

11. The apparatus of claim 10 including a perforated spark arrestor plate carried by said draft door preventing the flight of sparks outwardly from said draft opening whereby an enlarged draft opening and increased draft is afforded without the attendant risk of sparks.

12. The apparatus of claim 10 wherein said adjustable means comprises:

a guide flange carried by draft door;

an adjustable rod carried by said guide flange for movement relative thereto;

means connecting said rod to said slide plate;

lock means for locking the position and movement of said rod relative to said guide flange in one direction only while permitting free movement in an opposite direction; and said handle means carried by said rod.

13. The apparatus of claim 11 wherein said rod is threaded and is slidably carried for free vertical movement by said guide flange, said lock means including a nut member adjustably and threadably carried on said rod above said guide flange preventing movement in a downward direction while permitting free movement upwardly when grasped manually for opening said draft door.

* * * * *